United States Patent [19]

Shoemaker et al.

[11] 4,291,422

[45] Sep. 29, 1981

[54] HYDRAULIC TOILET SEAT

[76] Inventors: John J. Shoemaker, 1372 Willivee Dr., Decatur, Ga. 30033; Kenneth R. Stark, 10230 Fitzgerald Rd., Jonesburo, Ga. 30236

[21] Appl. No.: 153,892

[22] Filed: May 28, 1980

[51] Int. Cl.[3] ..... A47K 17/02

[52] U.S. Cl. ..... 4/251; 4/563; 4/566; 297/DIG. 10

[58] Field of Search ..... 4/251, 560, 561, 563, 4/566; 297/DIG. 10

[56] References Cited

U.S. PATENT DOCUMENTS

| | | | |
|---|---|---|---|
| 1,821,027 | 9/1931 | Oya | 4/251 |
| 2,214,323 | 9/1940 | Carter | 4/251 |
| 2,849,728 | 9/1958 | Gyllenberg | 4/251 |
| 3,925,833 | 12/1975 | Hunter | 4/251 |

*Primary Examiner*—Henry K. Artis
*Attorney, Agent, or Firm*—Marvin N. Benn

[57] ABSTRACT

A device for raising and lowering the lid and seat members of a toilet comprises a pair of independent hydraulic systems each operatively associated with one of the toilet members. Each hydraulic system includes a manually operable control valve, a hydraulic cylinder having a water inlet/outlet port disposed at each of its distal ends and means operatively connecting the piston rod of the cylinder to the associated toilet member. Either of the toilet members may be raised by operating the associated hydraulic system such that the control valve directs water to one of the cylinder ports while receiving exhaust water from the other port causing the piston rod to move in a first direction whereby the toilet member is pivotally moved in a counter clockwise direction. The toilet member is lowered by operating the control valve for reversing the cylinder ports receiving and exhausting water causing the piston rod to move in a second direction whereby the toilet member is pivotally moved in a clockwise direction.

13 Claims, 3 Drawing Figures

HYDRAULIC TOILET SEAT

BACKGROUND OF THE INVENTION

The present invention relates generally to mechanisms for raising and lowering toilet lid and seat members and, more particularly, to a mechanism utilizing the source of flushing water associated with a toilet for hydraulically raising and lowering the toilet lid and seat members.

The need for an efficient and safe mechanism for automatically raising and lowering the lid and seat members of a toilet bowl has long been recognized. The most often advanced justification for the provision of mechanisms of this general type involves the concern for hygiene wherein the necessity for the user of the toilet to handle or touch the toilet seat and/or lid is eliminated thereby preventing contamination should such members of the toilet not be in a thoroughly sanitary condition. A less frequently given justification is the convenience that such a mechanism affords the user of the toilet.

Ideally, a toilet seat and lid lifting and lowering mechanism should be capable of independently providing positive control of the position of the toilet lid and seat, it should be safe and convenient to operate and it should be inexpensive to manufacture and relatively easy to install requiring no significant modifications of the toilet bowl or water tank. While the relevant prior art discloses numerous examples of toilet seat and lid lifting and lowering mechanisms, none of these prior art mechanisms are known to satisfy all of the foregoing requirements.

For example, U.S. Pat. Nos. 2,200,687 to Bercot and 3,404,411 to Newkirk both disclose apparatus for automatically closing the toilet lid and seat some time after having been manually raised to an open position. The Bercot device, in addition, includes means for actuating the toilet flushing valve at the same time. U.S. Pat. No. 2,636,185 to Boston, on the other hand, discloses a mechanism employing spring force for automatically raising the toilet seat to its open substantially vertical position when not in use. In all of the foregoing cases, some manual manipulation of the toilet lid and seat is necessary to effect complete control thereover whereby these devices are not totally hygenically safe.

U.S. Pat. Nos. 1,821,027 to Oya and 2,214,323 to Carter both disclose apparatus operable for independently raising the toilet lid and seat through the agency of a hydraulic cylinder which is operable in response to the toilet water supply for linearly displacing a plunger or piston rod in a single predetermined direction to effect the desired movement of the toilet lid and seat. Suitably biased spring members are then used to lower the lid and seat after the water pressure has been relieved. U.S. Pat. No. 2,849,728 to Gyllenberg discloses a somewhat similar device except that both the lid and seat are raised simultaneously and lowering thereof is subsequently effected under the weight of the members after the water pressure has been removed. Toilet lid/seat lifting and lowering devices of the foregoing type are generally considered undesirable due to the lack of positive control provided. In particular, the time of seat lowering is not totally under the control of the toilet user but, rather, is largely dependent on the lowering mechanism itself. In addition, the spring members employed in these devices are quite cumbersome rendering their use highly undesirable.

The foregoing deficiences in the prior art are overcome by the toilet lid/seat lifting and lowering mechanism of the present invention which differs from the prior art in the provision of a pair of actuating members hydraulically reciprocable in two directions for positively controlling the movement of the toilet lid and seat at the complete discretion of the toilet user.

SUMMARY OF THE INVENTION

According to the present invention, the pivotal movement of the lid and seat members of a conventional toilet bowl are independently controllable by apparatus including a pair of hydraulic cylinders operable in response to the toilet bowl water supply. Each of the hydraulic cylinders includes a piston having a piston rod disposed for movement within its associated cylinder, each piston rod having its free end operatively coupled to one of the seat and lid members. Each of the cylinders further includes a pair of water inlet/outlet ports each disposed near one of the distal ends of its associated cylinder. A pair of control valves, each connected in association with a respective one of the hydraulic cylinders, are selectively operable by the toilet user for directing water to and from the inlet/outlet ports in a manner so as to effect the desired movement of the toilet lid or seat. In particular, the toilet lid may be raised to its open generally vertical position by operating the associated valve for directing water into one of the inlet/outlet ports of its hydraulic cylinder while receiving water exhausted from the other port. As a result, the piston rod within the cylinder is forced to move in a first direction causing the lid to be raised. By operating the valve for reversing the inlet/outlet ports which receive and exhaust water, the piston rod is forced to move in the opposite direction causing the toilet lid to be lowered to its closed generally horizontal position. The valve and hydraulic cylinder associated with the toilet seat may be operated in an analogous manner to positively control the position thereof.

DESCRIPTION OF THE PREFERRED EMBODIMENT

Figure 1:
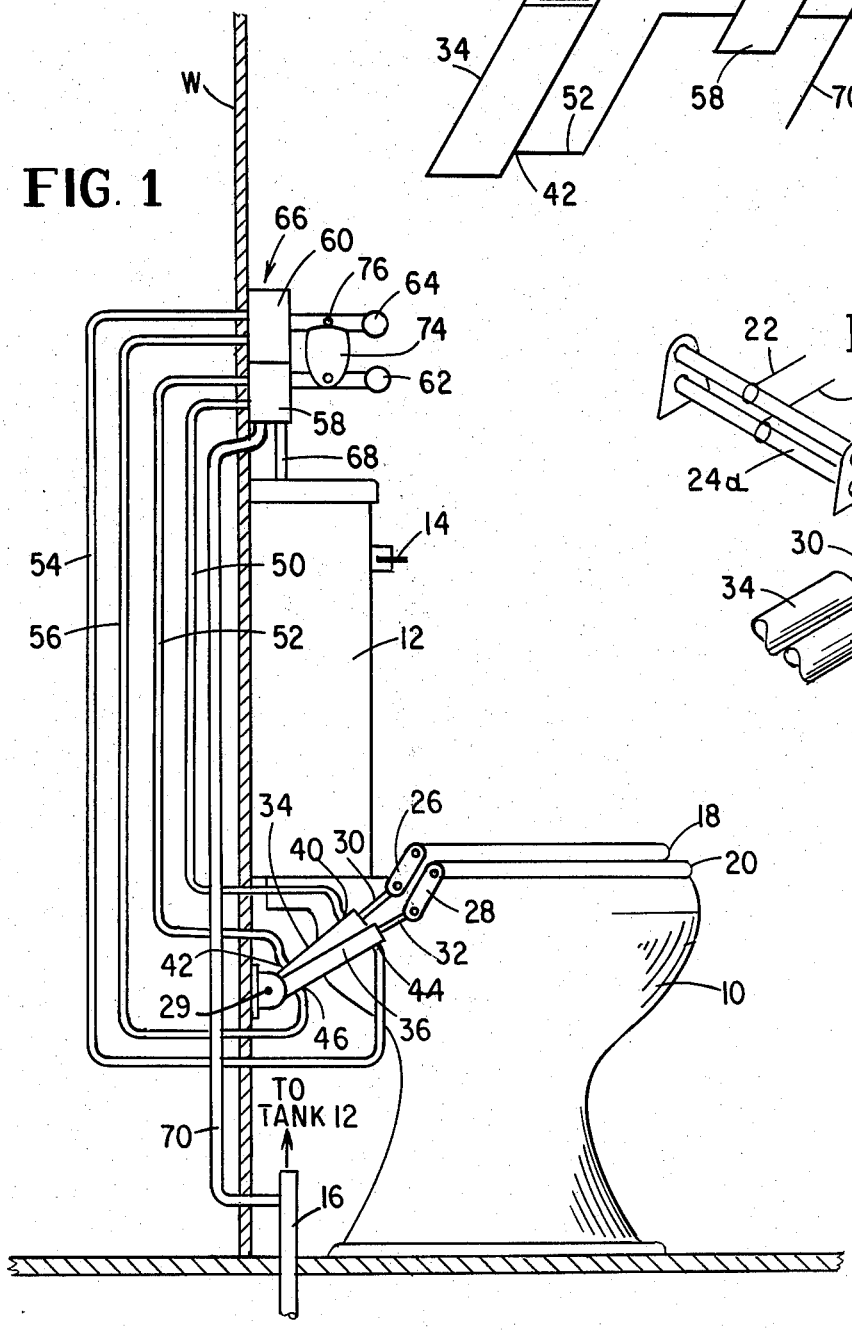
FIG. 1 is a view in side elevation showing the preferred embodiment of the present invention in association with a conventional toilet.
Figure 2:
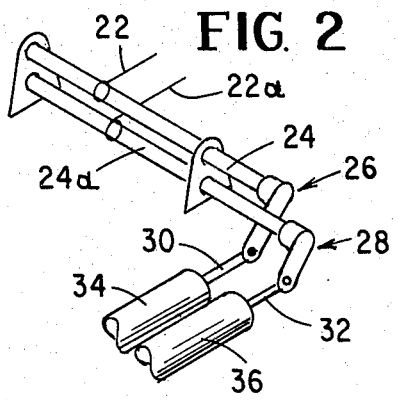
FIG. 2 is a fragmentary perspective view of a portion of the structure of FIG. 1.

Referring now to the drawings and, in particular to FIGS. 1 and 2, there is shown a conventional toilet which comprises a toilet bowl 10 and a water tank 12, the water tank 12 being provided with a lever or handle for actuating the usual flushing valve (not shown). A water supply line 16 directs water under pressure from a facility water supply for filling the water tank 12, the water being held within the tank 12 being exhausted through the toilet bowl 10 in response to operation of the lever 14. The bowl 10 is also provided with a lid 18 and a seat 20, which members are mounted in hinged relation with the bowl 10. More specifically, the lid 18 and the seat 20 each includes one or more hinge elements 22 and 22*a* respectively (see FIG. 2) secured to a rod or shaft 24 and 24*a* respectively, each of the shafts constituting an axis about which the lid 18 or the seat 20 is pivotable. Thus, in the usual manner, the lid 18 and the seat 20 are adapted for independent pivotal movement between a closed generally horizontal position and an open generally vertical position. It will be appreciated that the foregoing description contemplates a conventional toilet construction of the type well known in the art, which construction, therefore, need not be described in any further detail.

In accordance with the present invention, a bell crank 26 has one of its distal ends secured by suitable means, such as screws of the like, to the shaft 24 associated with hinge 22 and the toilet lid 18 and its opposite end shackled to the piston rod 30 of a hydraulic cylinder 34. A second bell crank 28, offset from bell crank 26, has one of its distal ends similarly secured to the shaft 24*a* associated with hinge 22*a* and the toilet seat 20 and its opposite end shackled to the piston rod 32 of a second hydraulic cylinder 36, both of the cylinders 34 and 36 being pinned to the wall W at their ends opposite bell cranks 26 and 28 as generally shown at 29. As will be described in further detail hereinafter, each of the piston rods 30 and 32 is reciprocable along the longitudinal axis of its associated hydraulic cylinder 34, 36 between a fully retracted position and a fully extended position. In their fully retracted positions, as shown in FIG. 1, the piston rods 30, 32 are effective for orienting the bell cranks 26 and 28 for allowing the lid 18 and seat 20 to be maintained in their closed generally horizontal position. Operation of the hydraulic cylinder 34 for causing piston rod 30 to move in an outwardly direction to its fully extended position causes the bell crank 26 to pivot about its fulcrum in a counter clockwise direction whereby the lid 18 is pivoted in a counter clockwise direction about the shaft 24 to its open generally vertical position. In a similar manner, operation of the hydraulic cylinder 36 for causing piston rod 32 to move in an outwardly direction to its fully extended position causes the bell crank 28 to pivot about its fulcrum in a counter clockwise direction whereby the seat 20 is pivoted in a counter clockwise direction about the shaft 24*a* to its open generally vertical position.

The seat 20 may subsequently be lowered to its closed position by operating the hydraulic cylinder 36 for causing piston rod 32 to move in an inwardly direction to its fully retracted position causing the bell crank 28 to pivot about its fulcrum in a clockwise direction thereby pivotally moving the seat 20 in a clockwise direction to its closed generally horizontal position. And, in a substantially identical manner, the hydraulic cylinder 34 may be operated for causing piston rod 32 to move in an inwardly direction to its fully retracted position for causing the bell crank 26 to pivot in a clockwise direction about its fulcrum thereby pivotally moving the lid 18 in a clockwise direction to its closed generally horizontal position. In the foregoing manner, the position of both the lid 18 and the seat 20 may be positively controlled through the operation of the hydraulic cylinders 34 and 36.

Each of the hydraulic cylinders 34 and 36 includes a pair of water inlet/outlet ports 40, 42 and 44, 46 respectively, disposed near the distal ends of the respective cylinders. The upper port 40 and lower port 42 of cylinder 34 are connected by a pair of water lines 50 and 52, respectively, to a first valve 58 while the upper port 44 and lower port 46 of cylinder 36 are connected by a pair of water lines 54 and 56 to a second valve 60. The valves 58 and 60, which include control levers 62 and 64, respectively, may be housed within a suitable container or control box, indicated generally at 66, disposed for providing the user of the toilet convenient access to the control levers 62 and 64. As will be explained in further detail hereinafter, both of the valves 58 and 60 are connected to a water exhaust line 68 which empties into the water tank 12 and to a water supply line 70 which is coupled to the facility water supply line 16.

Figure 3:
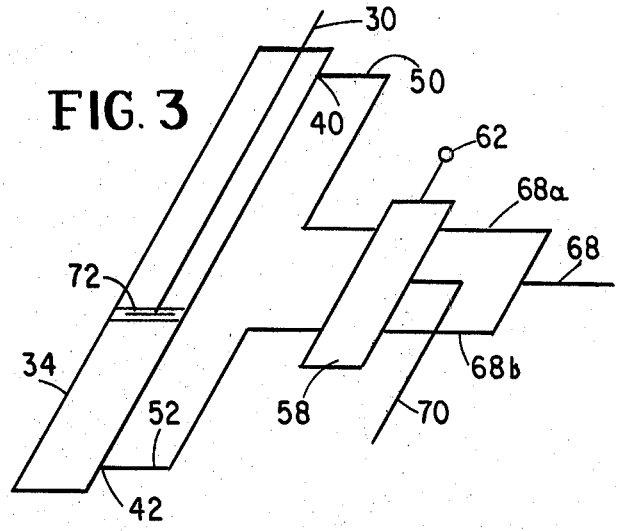
FIG. 3 is a schematic diagram illustrating the hydraulic operation of one of the two lifting and lowering mechanisms of the embodiment of the invention shown in FIG. 1.

The operation of the hydraulic system of the present invention is illustrated by the schematic flow diagram of FIG. 3. In that the hydraulic system consists of two separate but identical portions, only the portion associated with the toilet lid 18 is specifically illustrated in the diagram, it being understood that the portion associated with the toilet seat 20 is identical in construction and operation thereto.

Referring therefore to FIG. 3, as largely described above, the portion of the hydraulic system associated with the toilet lid 18 comprises the hydraulic cylinder 34 which includes a plunger or piston 72 operatively carrying the piston rod 30. The upper water inlet/outlet port 40 is connected by the water line 50 to valve 58 and the lower inlet/outlet port 42 is connected to valve 58 by water line 52. The valve 58 is further connected to the water supply line 70 and by a pair of water lines 68*a* and 68*b* to the water exhaust line 68. To facilitate the subsequent description of the operation of the illustrated hydraulic system, the plunger or piston 72 is shown at a generally central position within the cylinder 34.

In operation, assume that it is initially desired to raise the lid 18 to its open generally vertical position. In this case, the control lever 62 is moved to a first position wherein valve 58 is operated for connecting the water supply line 70 to the water line 52 and the water exhaust line 68 to the water line 50 through water line 68*a*. Water under pressure is consequently directed into the lower port 42 from water line 52 driving the piston 72 and piston rod 30 upward forcing the water at the top of the piston 34 to exhaust through the upper port 40 and the lines 50 and 68*a* to the water exhaust line 68 which empties into the water tank 12. As fully described above, this upwardly directed motion of the piston rod 30 causes the bell crank 26 to pivot in a counter clockwise direction which, in turn, causes the lid 18 to similarly pivot in a counter clockwise direction to its open generally vertical position.

In order to lower the lid 18 from its raised position, the control lever 62 is moved to a second position which reverses the flow of water through the valve 58. In particular, the water supply line 70 will now be connected to the water line 50 while the water exhuast line 68 is connected to the water line 52 through water line 68*b*. As a result, water under pressure is now directed into the upper port 40 from water line 50 driving the piston 72 and piston rod 30 downwardly forcing the water at the bottom of the piston 34 to exhaust through the lower port 42 and therefrom through the lines 52, 68*b* and 68 into the water tank 12. The downwardly directed motion of the piston rod 30 causes the bell crank 26 to pivot in a clockwise direction which, in turn, causes the lid to also pivot in a clockwise direction to its closed generally horizontal position.

As indicated above, the hydraulic cylinder 36 in cooperation with the water lines 54 and 56 and the valve 60 are operable in an identical manner for controlling the movement of the toilet seat 20. In particular, the water supply line 70 and the water exhaust line 68 are connected to valve 60 exactly as shown in FIG. 3 with the relation to valve 58 so that the piston rod 32 of cylinder 36 may be suitably reciprocated by selectively operating valve 60 for directing water into either inlet/-outlet port 44 or 46, while receiving exhaust water from the other port. Thus, the seat 20 may be raised by operating control lever 64 for causing valve 60 to direct water from the water supply line 70 to the lower port 46 of cylinder 36 while receiving exhaust water from upper port 44 whereby the piston rod 32 is driven in an upwardly direction effecting a counter clockwise pivotal motion of the seat 20. Lowering of the seat 20 is effected by operating valve 60 for directing water from the water supply line 70 to the upper port 44 while receiving exhaust water from the lower port 46 so that the piston rod 32 is driven downwardly effecting a clockwise pivotal motion of the seat 20.

Referring back to FIG. 1, the control box 66 preferably includes a cam device 74 having an upper surface engageable with a dowel pin 76 secured to control lever 64, the lower end of cam device 74 being pinned to control lever 62. As a consequence, the control levers 62 and 64 are interlocked such that lowering of control lever 64 causes simultaneous lowering of control lever 62 while raising of control lever 62 causes simultaneous raising of control lever 64. At the same time, control lever 64 may nevertheless be independently raised while control lever 62 may be independently lowered. Also, it will be appreciated that in certain applications only one hydraulic activation system may be required. For example, in most institutions the toilets are usually provided without lids so that control of only the toilet seat is necessary. The speed of raising or lowering the toilet lid or seat, or both, may also be suitably adjusted or controlled by installing needle valves or the like at appropriate positions within the hydraulic system to govern the rate of water flow.

While a particular embodiment of the present invention has been shown and described, it will be apparent that changes and modifications may be made therein without departing from the invention in its broader aspects. The aim of the appended claims, therefore, is to cover all such changes and modifications as fall within the true spirit and scope of the invention.

What is claimed is:

1. In a toilet bowl of the type having a seat member adapted for pivotal movement about a horizontal axis between a generally vertical position and a generally horizontal position, improved apparatus for positively controlling the movement of said seat member comprising:

a supply of water under pressure;

a hydraulic cylinder including a piston having a piston rod disposed for bi-directional movement along the longitudinal axis of said cylinder, said cylinder further including first and second water inlet/outlet ports each disposed near a respective distal end of said cylinder;

valve means selectively operable for supplying water from said water supply to said first inlet/outlet port while receiving water exhausted from said second inlet/outlet port for causing movement of said piston rod in a first direction and for supplying water from said water supply to said second inlet/-outlet port while receiving water exhausted from said first inlet/outlet port for causing movement of said piston rod in a second direction; and crank means operatively connecting said piston rod to said seat member for causing said seat member to assume said generally vertical position in response to movement of said piston rod in said first direction and for causing said seat member to assume said generally horizontal position in response to movement of said piston rod in said second direction.

2. The improved apparatus according to claim 1 including means directing the water exhausted from said first and second inlet/outlet ports to the water tank of said toilet bowl.

3. The improved apparatus according to claim 1 wherein said water supply comprises the source of water supply ordinarily used for flushing said toilet bowl.

4. The improved apparatus according to claim 1 wherein said crank means comprises a bell crank operatively connected between said piston rod and said seat member for raising and lowering said seat member in response to reciprocatory motion of said piston rod.

5. The improved apparatus according to claim 1 wherein said toilet bowl includes a lid member also adapted for pivotal movement about a horizontal axis between a generally vertical position and a generally horizontal position, said improved apparatus further comprising:

a second hydraulic cylinder including a piston having a piston rod disposed for bi-directional movement along the longitudinal axis of said second cylinder, said second cylinder further including third and fourth water inlet/outlet ports each disposed near a respective distal end of said second cylinder;

second valve means selectively operable for supplying water from said water supply to said third inlet/outlet port while receiving water exhausted from said fourth inlet/outlet port for causing movement of said piston rod in said first direction and for supplying water from said water supply to said fourth inlet/outlet port while receiving water exhausted from said third inlet/outlet port for causing movement of said piston rod in said second direction; and second crank means operatively connecting said piston rod of said second cylinder to said lid member for causing said lid member to assume said generally vertical position in response to movement of said piston rod of said second cylinder in said first direction and for causing said lid member to assume said generally horizontal position in response to movement of said piston rod of said second cylinder in said second direction.

6. The improved apparatus according to claim 5 including means directing water exhausted from said first, second, third and fourth inlet/outlet ports to the water tank of said toilet bowl.

7. The improved apparatus according to claim 6 wherein said water supply comprises the source of water supply ordinarily used for flushing said toilet bowl.

8. The improved apparatus according to claim 7 wherein said crank means and said second crank means each comprises a bell crank operatively connected between a respective one of said piston rods and one of said seat and lid members for independently raising and lowering said seat and lid members in response to reciprocatory motion of said piston rods.

9. In a toilet bowl of the type having lid and seat members each adapted for pivotal movement about a horizontal axis between a generally vertical position and a generally horizontal position, improved apparatus for positively controlling the movement of said lid and seat members comprising:

a supply of water under pressure;

first and second hydraulic cylinders each including a piston having a piston rod disposed for bi-directional movement along the longitudinal axis of its associated cylinder, each of said cylinders further including first and second water inlet/outlet ports disposed near a respective distal end of its associated cylinder;

first valve means selectively operable for supplying water from said water supply to said first inlet/outlet port of said first cylinder while receiving water exhausted from said second inlet/outlet port of said first cylinder for causing movement of said piston rod of said first cylinder in a first direction and for supplying water from said water supply to said second inlet/outlet port of said first cylinder while receiving water exhausted from said first inlet/outlet port of said first cylinder for causing movement of said piston of said first cylinder in a second direction;

second valve means selectively operable for supplying water from said water supply to said first inlet/outlet port of said second cylinder while receiving water exhausted from said second inlet/outlet port of said second cylinder for causing movement of said piston rod of said second cylinder in a second direction and for supplying water from said water supply to said second inlet/outlet port of said second cylinder while receiving water exhausted from said second cylinder for causing movement of said piston rod of said second cylinder in a first direction;

first crank means operatively connecting said piston rod of said first cylinder to said lid member for causing said lid member to assume said generally vertical position in response to movement of said piston rod of said first cylinder in said first direction and for causing said lid member to assume said generally horizontal position in response to movement of said piston rod of said first cylinder in said second direction; and second crank means operatively connecting said piston rod of said second cylinder to said seat member for causing said seat member to assume said generally vertical position in response to movement of said piston rod of said second cylinder in said first direction and for causing said seat member to assume said generally horizontal position in response to movement of said piston rod of said second cylinder in said second direction.

10. The improved apparatus according to claim 9 including means directing water exhausted from said first and second inlet/outlet ports of said first and second cylinders to the water tank of said toilet bowl.

11. The improved apparatus according to claim 9 wherein said water supply comprises the source of water supply ordinarily used for flushing said toilet bowl.

12. The improved apparatus according to claim 9 wherein said first and second crank means each comprises a bell crank operatively connected between a respective one of said piston rods of said first and second cylinders and one of said lid and seat members for independently raising and lowering said lid and seat members in response to reciprocatory motion of said piston rods.

13. The improved apparatus according to claim 9 including interlocking means cooperating with said first and second valve means for allowing said lid and seat members to simultaneously assume said generally vertical position or said generally horizontal position in response to operation of only one of said valve means, said interlocking means also permitting operation of said first and second valve means for independently causing said lid members to assume said generally vertical position and said generally horizontal position.

* * * * *